US006843387B2

(12) United States Patent
Karaki et al.

(10) Patent No.: US 6,843,387 B2
(45) Date of Patent: Jan. 18, 2005

(54) COVER FOR DESICCANT DISPENSER

(75) Inventors: Yutaka Karaki, Hyogo (JP); Stefan Dick, Albuquerque, NM (US)

(73) Assignee: Sanai Kabushiki Kaisha, Osaka (JP)

( * ) Notice: Subject to any disclaimer, the term of this patent is extended or adjusted under 35 U.S.C. 154(b) by 0 days.

(21) Appl. No.: 09/969,872

(22) Filed: Oct. 4, 2001

(65) Prior Publication Data

US 2002/0139799 A1 Oct. 3, 2002

(30) Foreign Application Priority Data

Apr. 2, 2001 (JP) ..... 2001-103286

(51) Int. Cl.[7] ..... B65D 51/00

(52) U.S. Cl. ..... 220/229; 220/797; 220/799; 220/802; 220/803; 220/804; 220/729; 220/254.2; 220/256.1

(58) Field of Search ..... 220/255, 229, 220/254.1, 254.2, 256.1, 799–801, 803, 804, 729, 87.1, 802; 215/364; 138/89, 90, 112; 206/366, 374

(56) References Cited

U.S. PATENT DOCUMENTS

| | | | | | |
|---|---|---|---|---|---|
| 655,348 | A | * | 8/1900 | Moore | 220/801 |
| 1,983,139 | A | * | 12/1934 | Lovell | 220/256.1 |
| 2,436,291 | A | * | 2/1948 | Daniel | 220/229 |
| 3,104,681 | A | * | 9/1963 | Gray, Jr. | 138/96 R |
| 3,116,927 | A | * | 1/1964 | Kuhlman | 220/229 |
| 3,618,814 | A | * | 11/1971 | Nagroski | 220/804 |
| 3,739,936 | A | * | 6/1973 | Jones, Jr. | 220/229 |
| 3,748,781 | A | * | 7/1973 | Erling | 220/229 |
| 4,082,204 | A | | 4/1978 | Savage | |
| 4,329,857 | A | * | 5/1982 | Kittle et al. | 220/229 |
| 4,331,254 | A | * | 5/1982 | Haggerty | 220/229 |
| 4,673,393 | A | * | 6/1987 | Suzuki et al. | 138/89 |
| 4,884,717 | A | * | 12/1989 | Bussard et al. | 220/229 |
| 5,052,578 | A | * | 10/1991 | Goodwin | 220/281 |
| 6,176,384 | B1 | | 1/2001 | Voloshin | |

FOREIGN PATENT DOCUMENTS

| | | | | |
|---|---|---|---|---|
| EP | 339729 A1 | * | 11/1989 | B65F/1/16 |
| GB | 2 152 913 A | | 8/1985 | |

* cited by examiner

*Primary Examiner*—Robin A. Hylton
(74) *Attorney, Agent, or Firm*—Arent Fox, PLLC

(57) ABSTRACT

A cover for a desiccant dispenser is mounted over an opening of a bucket-shaped container containing a plurality of desiccant bags. The cover includes a hard main plate having a taking-out bore for insertion of a hand to take out the desiccant bags, and one elastic plate mounted on the main plate to cover the taking-out bore and having a plurality of cuts arranged radiately to permit the insertion and withdrawal of the hand. This can greatly extend the duration of the activity of desiccant bags placed in a bucket-shaped container of a dispenser, particularly desiccant bags located in an uppermost layer.

6 Claims, 11 Drawing Sheets

COVER FOR DESICCANT DISPENSER

BACKGROUND OF THE INVENTION

1. Field of the Invention

The present invention relates to a cover for desiccant dispenser, and particularly to a cover adapted to be mounted over an opening of a bucket-shaped container containing a plurality of desiccant bags. As used herein, the term "desiccant bag" means an air-permeable bag containing a powdered or granular desiccant packed therein.

2. Relevant Art

Such a desiccant dispenser has been used to store desiccant bags which are placed in a moisture-proof package containing chips, for example, on a packing line in a semiconductor-producing factory. The reason why the desiccant bag is placed in the moisture-proof package is to prevent the following disadvantage: If moisture is contained in the chip, there is a possibility that the moisture is expanded in heating and bonding process, to thereby damage the chip.

In this case, a large number of desiccant bags are placed in the bucket-shaped container, and the opening of the container is left to be opened in order that that an operator may take out the desiccant bags easily.

In the above-described dispenser, however, a plurality of desiccant bags located in an uppermost layer are exposed to the environmental humidity, and for this reason, in such a case where the operation is discontinued, the activity of these desiccant bags is liable to decline significantly due to the absorption of moisture. Even if such desiccant bags are placed in the moisture-proof package, the purpose of this placement cannot be achieved, and there is a possibility that a large amount of damage may be provided.

SUMMARY OF THE INVENTION

It is an object of the present invention to provide a cover of the above-described type which can greatly extend the duration of the activity of desiccant bags placed in a bucket-shaped container of a dispenser, particularly desiccant bags located in an uppermost layer.

To achieve the above object, according to the present invention, there is provided a cover for a desiccant dispenser, which is adapted to be mounted over an opening of a bucket-shaped container containing a plurality of desiccant bags, and which comprises a hard main plate having a taking-out bore for insertion of a hand to take out the desiccant bags, and at least one elastic plate mounted on the main plate to cover the taking-out bore and having a plurality of cuts arranged radiately to permit the insertion and withdrawal of the hand.

With the above arrangement, in a state in which the plurality of desiccant bags are placed in the bucket-shaped container and the cover is mounted over the opening of the container, elastic pieces of the elastic plate between the adjacent cuts are in extended states to minimize the degree of communication between the inside and outside of the container through the cuts. Thus, the exposure of the plurality of desiccant bags located in the uppermost layer to the environmental humidity is inhibited and hence, the duration of the activity of the desiccant bags can be greatly extended.

The motion of an operator inserting his hand into the taking-out bore to take out the desiccant bags is permitted by the flexing of the elastic pieces of the elastic plate toward the inside of the container. At this time, the degree of communication between the inside and outside of the container is maintained small, because the elastic pieces are brought into the hand. On the other hand, the motion of the operator grasping the plurality of desiccant bags to withdraw his hand out of the taking-out bore is permitted by the flexing of the elastic pieces of the elastic plate toward the outside of the container. At this time, the degree of communication between the inside and outside of the container is maintained smaller, because the elastic pieces are brought into the hand. When the operator's hand is parted from the elastic pieces, the elastic pieces extends as described above, whereby the degree of communication between the inside and outside of the container through the cuts is minimized.

The above and other objects, features and advantages of the present invention will be apparent from the following detailed description of preferred embodiments made in conjunction with the accompanying drawings.

DETAILED DESCRIPTION OF PREFERRED EMBODIMENTS

Figure 1:
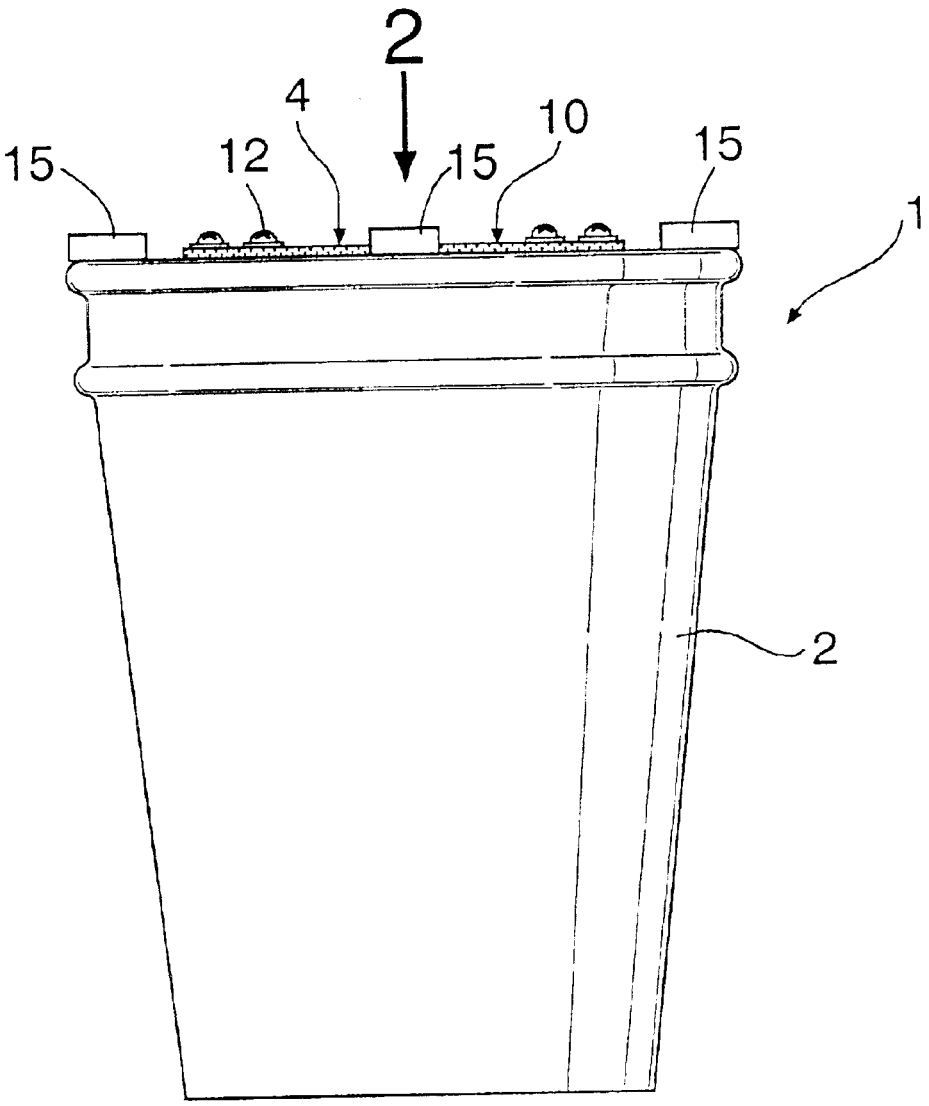
FIG. 1 is a side view of a first embodiment of a desiccant dispenser.

FIGS. 1 to 5 show a first embodiment of the present invention. A desiccant dispenser 1 comprises a bucket-shaped container 2, and a disk-shaped cover detachably mounted over a circular opening 3 of the container 2. The container 3 is made of, for example, a metal and contains a plurality of desiccant bags 5. Examples of desiccants which may be used are clay, silica gel, a molecular sieve and the like.

The cover 4 includes a main hard plate 8 having at its central portion a circular taking-out bore 7 for insertion of a hand 6 to take out the desiccant bags 5, and at least one (one in the first embodiment) elastic plate 10 which is mounted to the main plate 8 to cover the taking-out bore 7 and has a plurality of cuts 9 arranged radiately to permit the insertion and withdrawal of the hand 6. The main plate 8 is formed of a transparent synthetic resin, e.g., an acrylic plastic. The elastic plate 10 is cut from a plate material made of a destaticized synthetic rubber, e.g., a chloroprene rubber, into a regular octagonal shape, and is mounted on an outer face of the main plate 8 around the taking-out bore 7 in such a manner that its portions corresponding to the bisected points of the sides are secured to the outer face by means of washers 11 and tapping screws 12. The center of the elastic plate 10 is aligned with the center of the taking-out bore 7, and eight cuts 9 are arranged radiately to extend from the center of the elastic plate 10 to the vicinity of an inner peripheral edge of the taking-out bore 7 so that the cuts 8 form eight equilateral triangular elastic pieces 13 having the same vertical angles $\alpha$.

The main plate 8 has an annular seal member 14 provided on its outer peripheral surface so as to come into close contact with an inner peripheral surface of the opening 3 of the container 2, and a plurality of stoppers 15 provided on an outer periphery of its surface and engaged with an end face of the opening 3 of the container 2. The annular seal member 14 is made of a synthetic rubber, e.g., a chloroprene rubber. Each of the stoppers 15 is formed a transparent acrylic plastic similar to the material forming the main plate 8 and attached at its one end to the main plate 8 by a tapping screw 16, with the other end protruding outside the seal member 14, so that the stoppers 15 functions as an engage portion for engagement with the end face of the opening 3 of the container 2.

Figure 2:
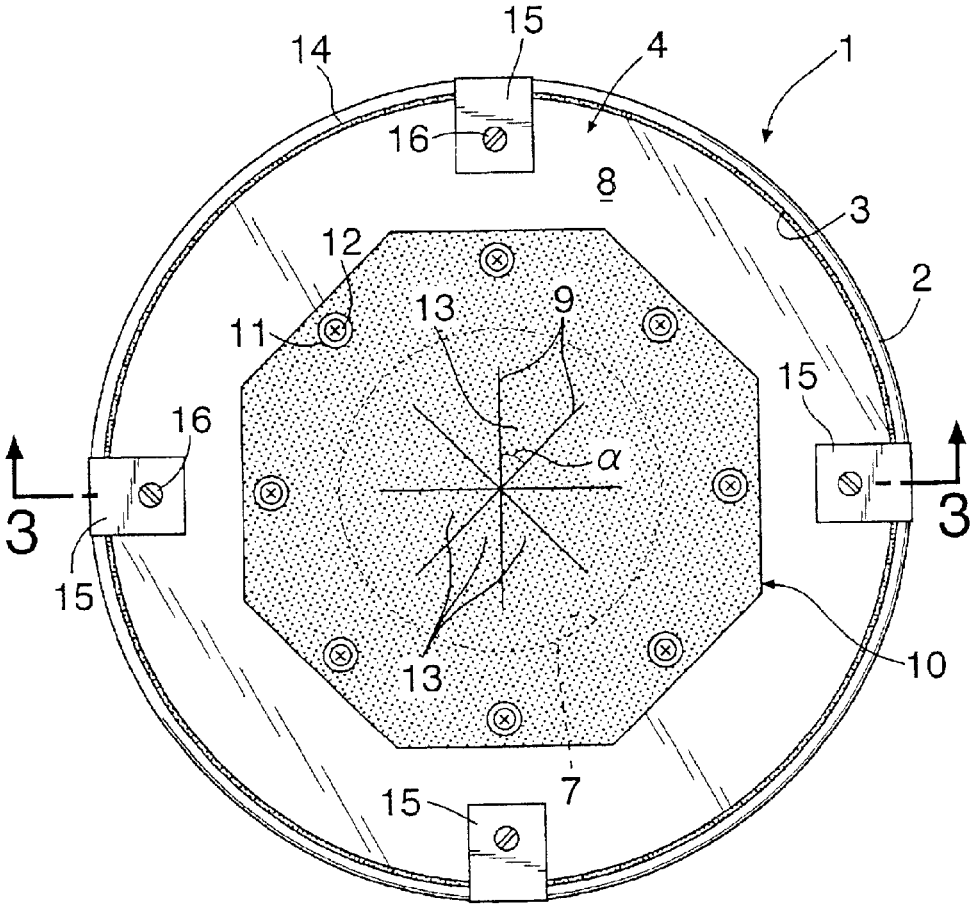
FIG. 2 is a view taken in the direction of arrow 2 in FIG. 1.
Figure 3:
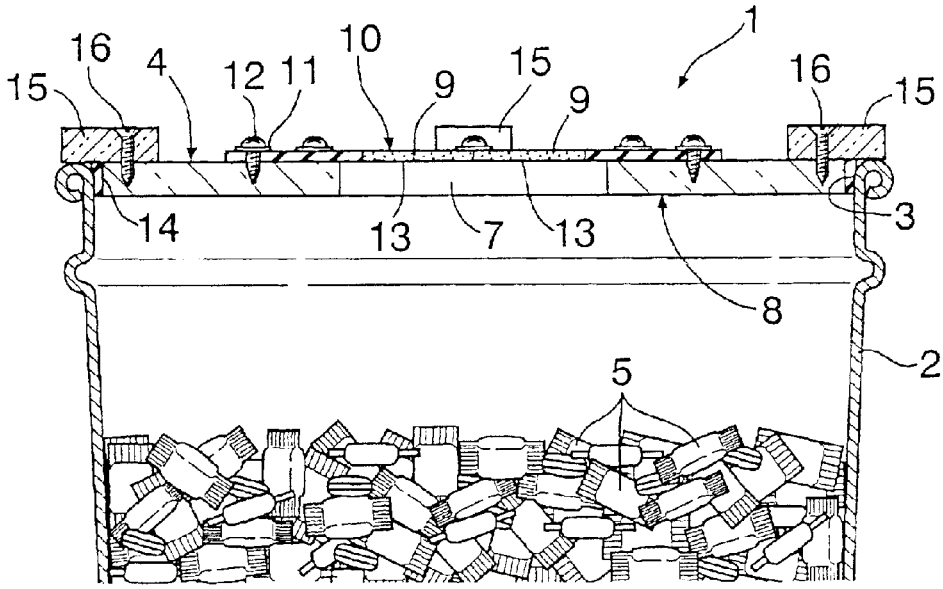
FIG. 3 is a vertical sectional view of an essential portion of the first embodiment of the desiccant dispenser, taken along a line 3—3 in FIG. 2.
Figure 4:
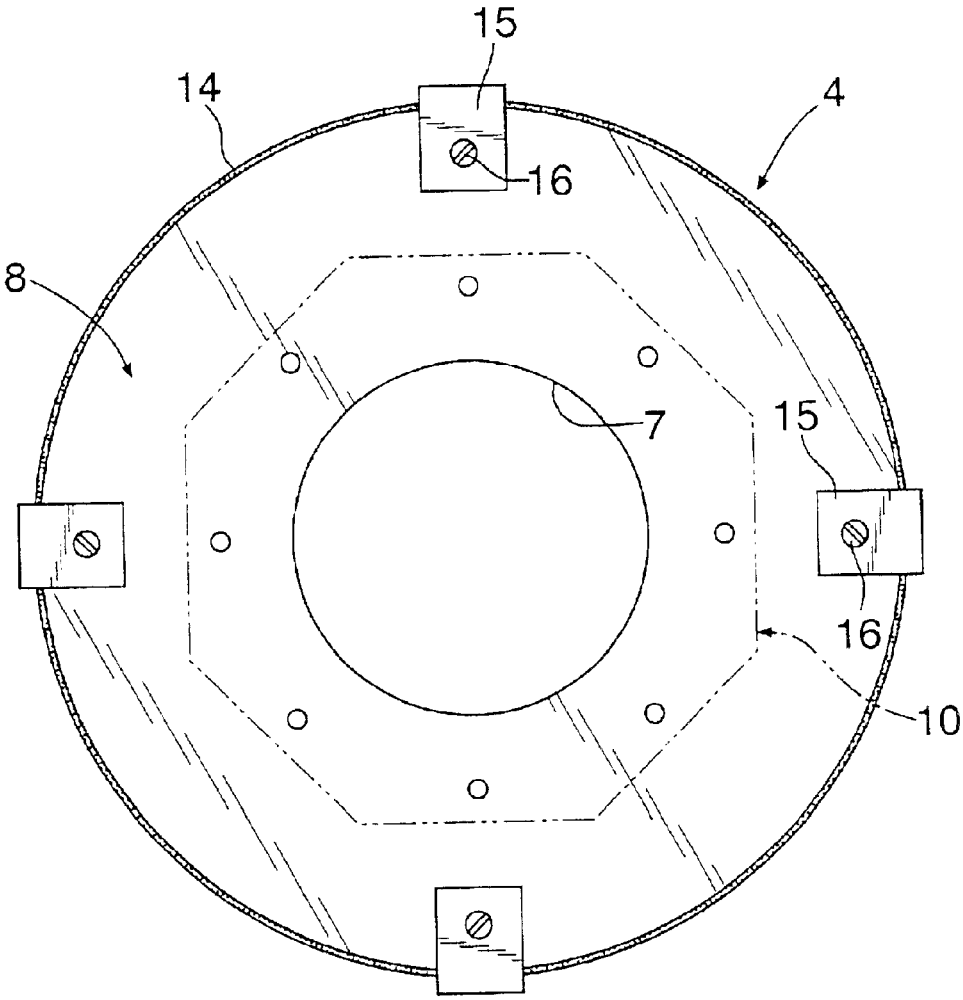
FIG. 4 is a plan view of a main plate of a cover.

As shown in FIGS. 2 and 3, in a state in which the plurality of desiccant bags 5 are placed in the containers 2 and the cover 4 is mounted over the opening 3 of the container 2, each of the elastic pieces 13 between the adjacent cuts in the elastic plate 10 is in an extended state, so that the degree of communication between the inside of the container 2 and the outside through the cuts 9 is the smallest. Thus, the exposure of the plurality of desiccant bags 5 located in the uppermost layer to the environmental moisture is inhibited and hence, the activity of the desiccant bags 5 can be greatly extended.

Figure 5:
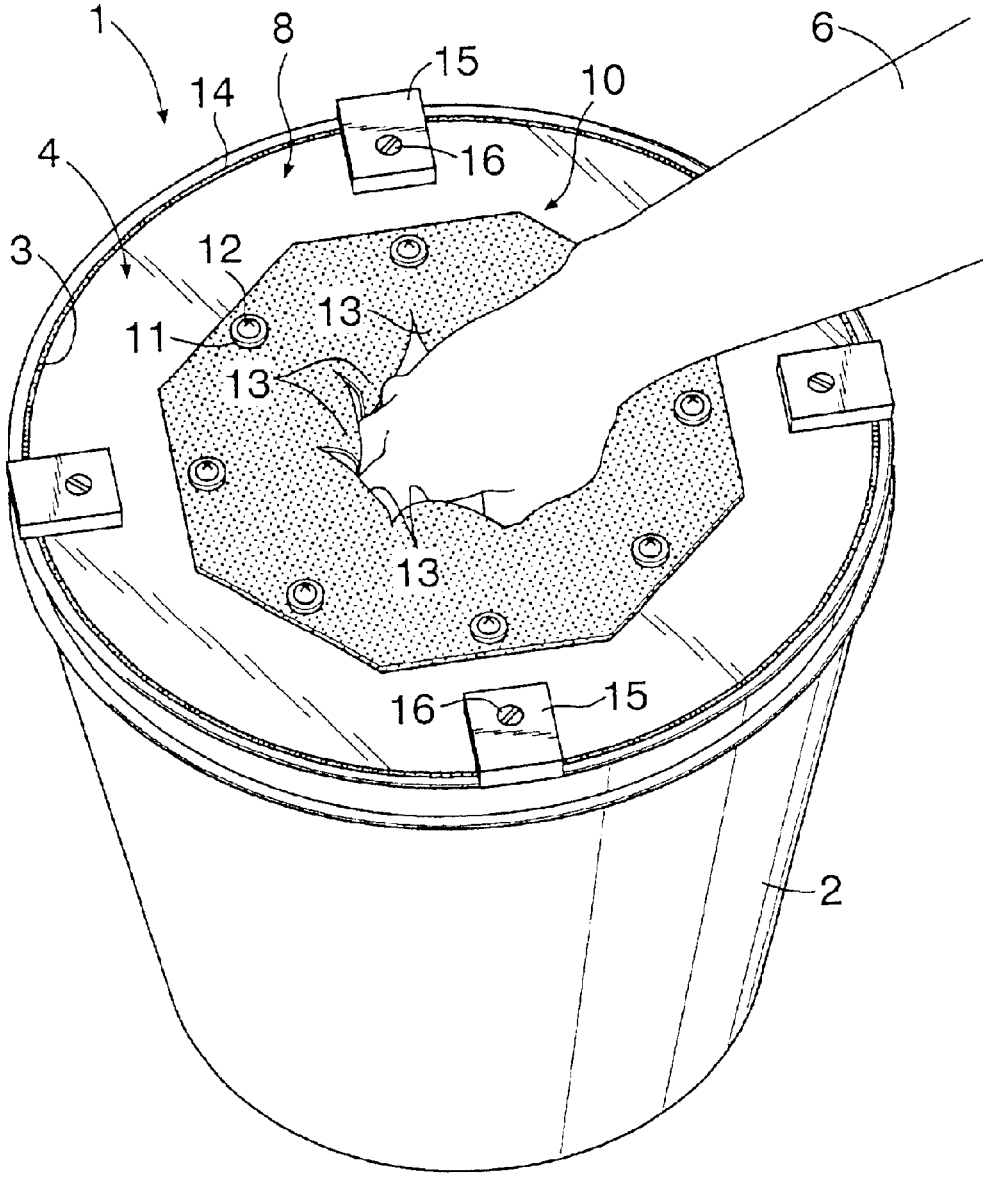
FIG. 5 is a perspective view of the desiccant dispenser in a state in use.

As shown in FIG. 5, the motion of an operator inserting his hand 6 into the taking-out bore 7 to take out the desiccant bags 5 is permitted by the flexing of the elastic pieces 13 of the elastic plate 10 toward the inside of the container 2. At this time, the degree of communication between the inside of the container 2 and the outside is maintained small, because the elastic pieces 13 are brought into contact with the hand 6. On the other hand, the motion of the operator grasping the plurality of desiccant bags 5 to withdraw his hand out of the taking-out bore 7 is permitted by the flexing of the elastic pieces 13 of the elastic plate 10 toward the outside. At this time, the degree of communication between the inside of the container 2 and the outside is maintained small through cuts 9, because the elastic pieces 13 are brought into contact with the hand. When the hand 6 is parted from the elastic pieces 13, the elastic pieces 13 extends as described above and as a result, the degree of communication between the inside and outside of the container 2 is minimized.

In addition, the annular seal member 14 of the main plate 8 is in close contact with the inner peripheral surface of the opening 3 of the container 2 and hence, the sealability for the opening 3 is good. Also, even when the container 2 is laid down, the cover 4 cannot be detached from the container 2 and hence, scattering of the desiccant bags 5 through the opening 3 of the container is prevented. In this case, the spillage of the desiccant bags 5 through the taking-out bore 7 is inhibited by the elastic plate 10.

Further, the detachment of the cover 4 from the opening 3 of the container 2 is easily conducted by grasping an edge of the taking-out bore 7. Yet further, the main plate 8 is transparent and hence, it is possible for the operator to know the amount of the desiccant bags 5 remaining in the container 2 without removal of the cover 4, that is, without exposure of the desiccant bags 5 to the environmental humidity.

A moisture absorption test will be described below.

33 g of powdered clay was packed in each of bags made of an air-permeable synthetic paper (made under a trade name of Tyvek by Du Pont de Nemours), to thereby prepare a plurality of desiccant bags 5. These desiccant bags 5 were made in the S-CPP Belen plant of S-CPP Co., Ltd. in United State of America.

First, three desiccant bags 5 were placed on a bottom of a container 2 of about 19 L and then, a cover 4 was mounted over an opening 3 of the container 2. This is hereinafter referred to as Example 1. Three similar desiccant bags 5 were placed on a bottom of another container 2. In this case, the container 3 was left open without a cover 4 mounted over an opening 3 of the container 3. This is hereinafter referred to as Example 2.

Both the containers 2 were placed under an environment having a temperature of 30° C. and a relative humidity of 60% according to a rule under JEDEC standard floor conditions, and the relationship between lapsed time and the amount of moisture absorbed in the desiccant bags 5 were examined. JEDEC is initials of JOINT ELECTRON DEVICE ENGINEERING COUNCIL. The amount A of humidity absorbed was obtained from an equation;

$$A=\{(W2-W1)/W1\}\times 100 \text{ (\% by weight)}$$

wherein W1 represents the weight of the desiccant bag at the start of the humidity absorption test, and W2 represents the weight of the desiccant bag after lapse of a predetermined time. In each of Examples 1 and 2, an average value of the amounts A of humidity absorbed in the three desiccant bags 5 was calculated.

Figure 6:
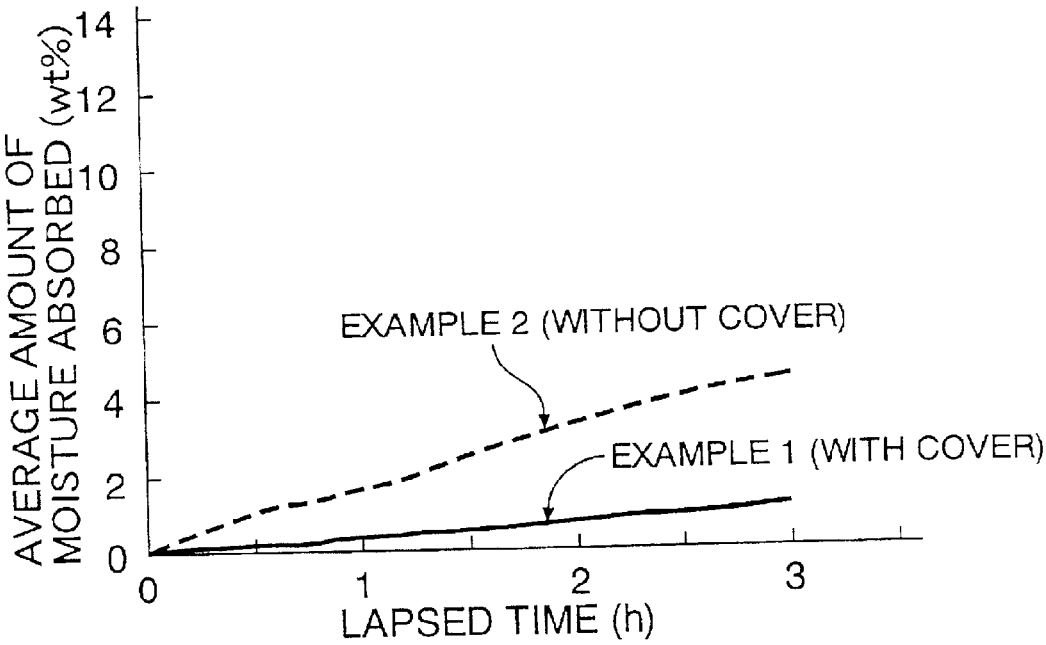
FIG. 6 is a graph showing a first instance of the relationship between the lapsed time and the average amount of moisture absorbed.
Figure 7:
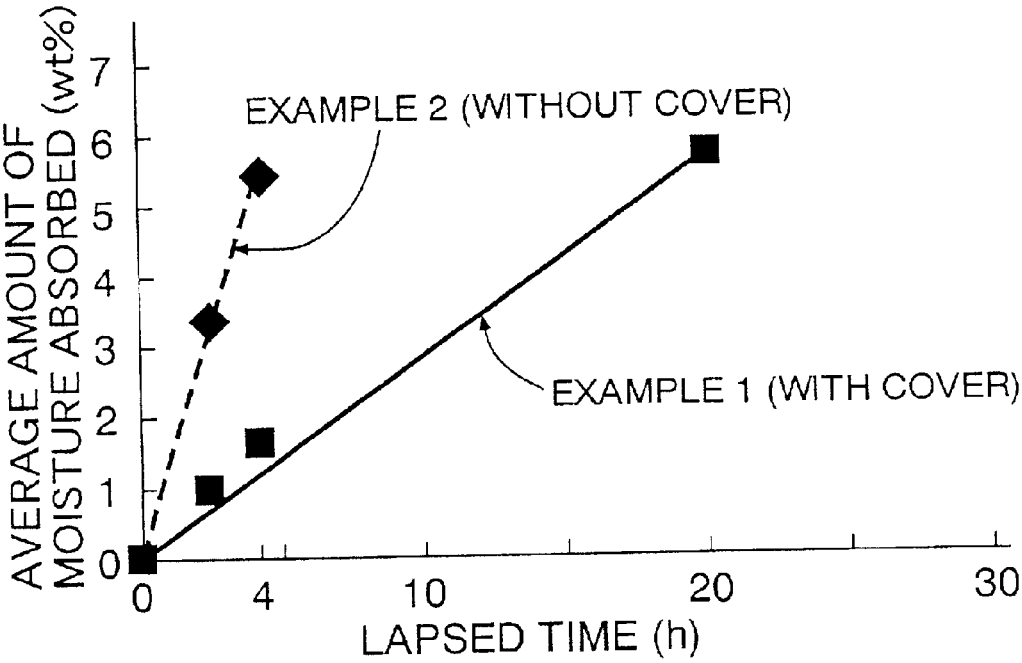
FIG. 7 is a graph showing a second instance of the relationship between the lapsed time and the average amount of moisture absorbed.
Figure 8:
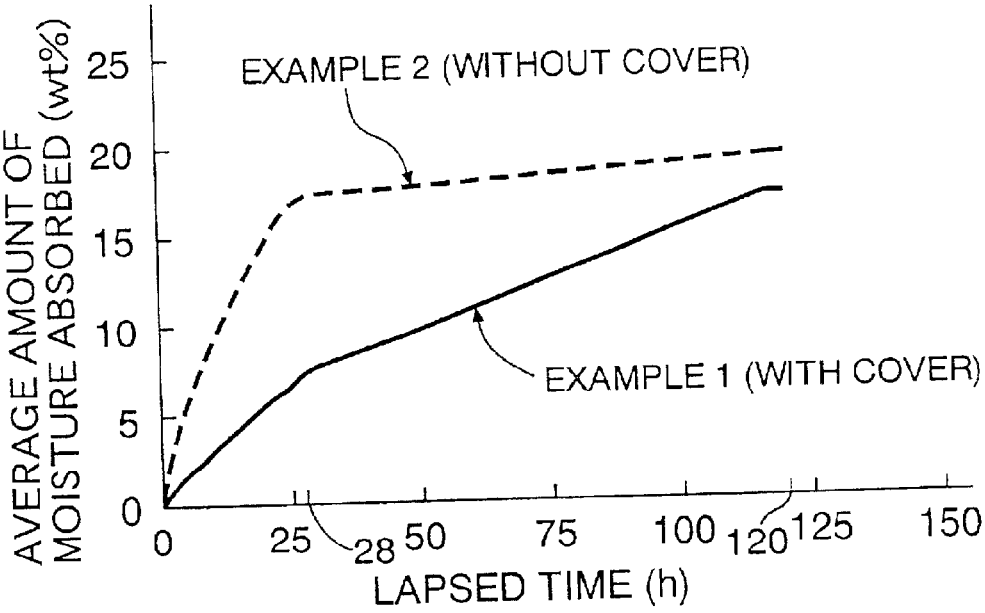
FIG. 8 is a graph showing a third instance of the relationship between the lapsed time and the average amount of moisture absorbed.

FIG. 6 shows variations in average amounts of moisture absorbed in Examples 1 and 2 when three hours lapsed. FIG. 7 shows a variation in average amount of moisture absorbed in Example 1 when twenty hours lapsed, and a variation in average amount of moisture absorbed in Example 2 when four hours lapsed. FIG. 8 shows variations in average amounts of moisture absorbed in Examples 1 and 2 when 120 hours lapsed.

As apparent from FIGS. 6 to 8, it can be seen that the average amount of moisture absorbed in the desiccant bag 5 in Example 1 using the cover 4 is smaller than that in Example 2 not using the cover 4. A difference between the moisture-proof abilities is manifest from the start of the test as seen from FIGS. 6 and 7. Such difference is only increased from the start of the test to a time when 28 hours lapsed, as shown in FIG. 8. Thereafter, Example 2 proceed to a saturated state at a very slow moisture absorption rate, and Example 1 proceed to a saturated state at a moisture absorption rate larger than that of Example 2.

To ensure that the desiccant bag 5 performs its function within a moisture-proof package containing chips, the exposure time for reaching such amount of moisture absorbed in the above-described high-temperature and high-humidity environment was 75 minutes from the start of the test in the case of Example 1, and 15 minutes from the start of the test in the case of Example 2, provided that the amount of moisture absorbed by the desiccant bag before being placed in the moisture-proof package was 0.5% by weight. From this, a moisture-proof effect provided by the cover 4 is obvious.

Figure 9:
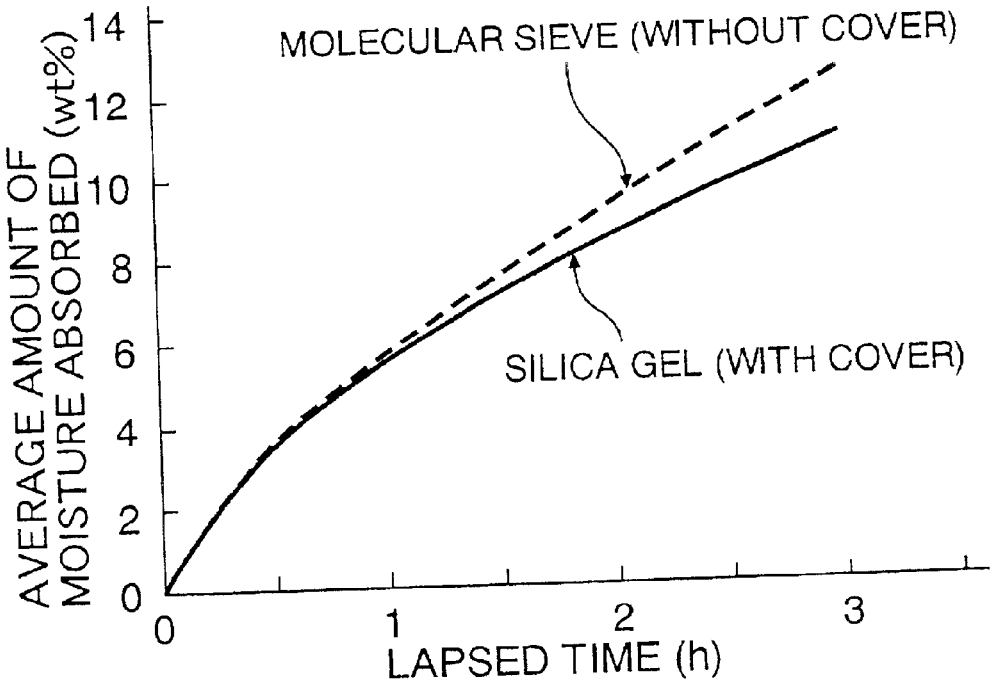
FIG. 9 is a graph showing a fourth instance of the relationship between the lapsed time and the average amount of moisture absorbed.

FIG. 9 is similar to FIG. 6, but shows moisture-proof properties in a cover-free state for a desiccant bag using a molecular sieve as a desiccant and for a desiccant bag using silica gel as a desiccant. Even for such desiccant bags, it is possible to enhance the moisture-proof property by applying the cover 4. In this case, the exposure time was 4 minutes in both the silica gel and molecular sieve desiccant bags, but if the cover 4 is used, the exposure time can be extended to about 20 minutes.

Figure 10:
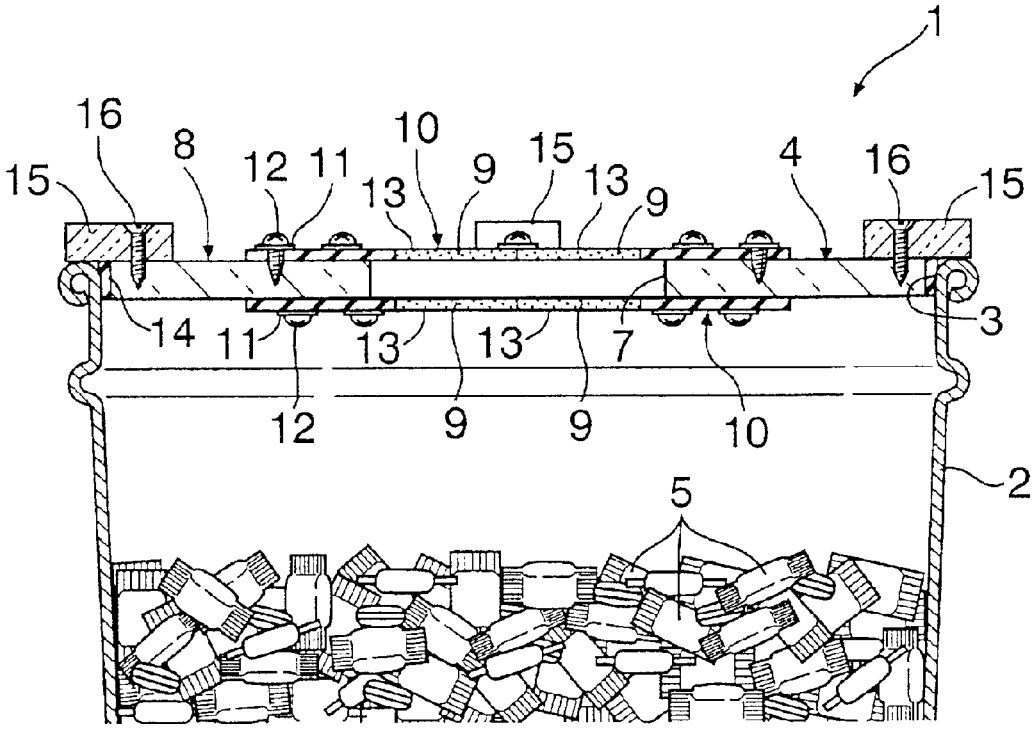
FIG. 10 is a vertical sectional view similar to FIG. 3, but showing an essential portion of a second embodiment of a desiccant dispenser.

FIG. 10 shows a second embodiment in which a cover 4 comprises two elastic plates 10 attached to opposite faces of a main plate 8. In this case, pluralities of cuts 9 in the two elastic plates 10 are opposed to each other. If a taking-out bore 7 is covered from opposite directions as described above, the moisture-proof property in a container 2 can be further improved.

Figure 11:
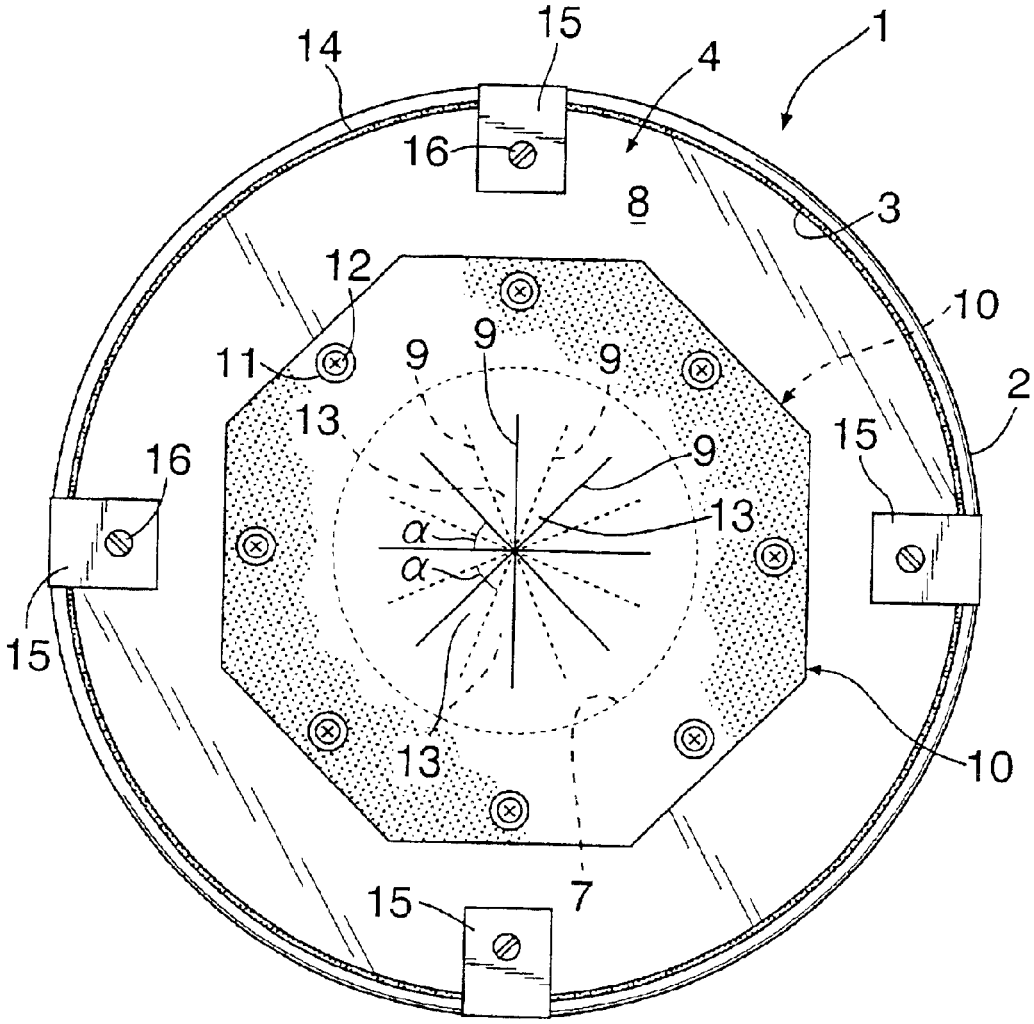
FIG. 11 is a plan view similar to FIG. 2, but showing a third embodiment of a desiccant dispenser.

FIG. 11 shows a third embodiment. In a cover 4, a plurality of cuts 9 in an elastic plate 10 on the outer face and a plurality of cuts 9 in an elastic plate 10 on the inner face are offset in a staggered manner. With this structure, the inside and outside of a container 2 cannot be put into direct communication with each other through cuts 9 in the elastic plate 10 on the outer face, leading to an improved moisture-proof property in the container 2.

The container 3 may be of a moisture-absorbing property, and a plastic may be used as a material for the container 3. A polycarbonate may be used as a material for forming the main plate 8. A synthetic rubber other than a chloroprene rubber may be used, or a thermoplastic material such as a polyvinyl chloride or an ethylene-vinyl acetate copolymer may be used as a material for forming the elastic plate 10 and the annular seal member 14.

According to the present invention, by the above-described arrangement, it is possible to provide a cover which can greatly extend the duration of the activity of the desiccant bags placed in the bucket-shaped container of the dispenser, particularly, the desiccant bags located in the uppermost layer.

What is claimed is:

1. A cover for a desiccant dispenser, which is adapted to be mounted over an opening of a container having a closed base on a bottom end and the opening on an upper end and containing a plurality of desiccant bags, the cover comprising:

a hard main plate having a taking-out bore for insertion of a hand to take out said desiccant bags, wherein said main plate has, on its outer peripheral surface, a seal member for close contact with an inner peripheral surface of the opening of the container and, on an outer periphery of its outer face, a plurality of stoppers for engagement with an end face of the opening of the container; and at least one elastic plate mounted on said main plate to cover said taking-out bore and having a plurality of cuts arranged radially to permit the insertion and withdrawal of the hand.

2. A cover for a desiccant dispenser, which is adapted to be mounted over an opening of a container having a closed base on a bottom end and the opening on an upper end and containing a plurality of desiccant bags, the cover comprising:

a hard main plate having a taking-out bore for insertion of a hand to take out said desiccant bags, wherein said main plate is made of a transparent synthetic resin, and said main plate has, on its outer peripheral surface, a seal member for close contact with an inner peripheral surface of the opening of the container and, on an outer periphery of its outer face, a plurality of stoppers for engagement with an end face of the opening of the container; and at least one elastic plate mounted on said main plate to cover said taking-out bore and having a plurality of cuts arranged radially to permit the insertion and withdrawal of the hand.

3. A cover for a desiccant dispenser, which is adapted to be mounted over an opening of a container having a closed base on a bottom end and the opening on an upper end and containing a plurality of desiccant bags, the cover comprising:

a hard main plate having a taking-out bore for insertion of a hand to take out said desiccant bags, wherein said main plate is adapted to be fitted and fixed at its outer peripheral surface in an inner peripheral surface of the opening of the container; and an elastic plate mounted on an inner face of said main plate and another elastic plate mounted on an outer face of said main plate with a spacing therebetween to cover said taking-out bore and each having a plurality of cuts arranged radially to permit the insertion and withdrawal of the hand.

4. A cover for a desiccant dispenser according to claim 3, wherein said main plate is made of a transparent synthetic resin.

5. A cover for a desiccant dispenser according to claim 3, wherein the plurality of cuts in the elastic plate on the outer face and the plurality of cuts in the elastic plate on the inner face are offset in a staggered manner.

6. A cover for a desiccant dispenser according to claim claim 3, 4, or 5, wherein said main plate has, on its outer peripheral surface, a seal member for close contact with said inner peripheral surface of the opening of the container and, on an outer periphery of its outer face, a plurality of stoppers for engagement with an end face of the opening of the container.

* * * * *